United States Patent [19]

Synofzik et al.

[11] Patent Number: 4,671,179

[45] Date of Patent: Jun. 9, 1987

[54] CARTRIDGED AMMUNITION FOR GUN BARREL WEAPONS

[75] Inventors: Reinhard Synofzik, Jüchen; Michael Schwenzer; Peter Wallow, Düsseldorf, all of Fed. Rep. of Germany

[73] Assignee: Rheinmetall GmbH, Düesseldorf, Fed. Rep. of Germany

[21] Appl. No.: 711,395

[22] Filed: Mar. 13, 1985

[30] Foreign Application Priority Data

Mar. 13, 1984 [DE] Fed. Rep. of Germany ..... 3409017

[51] Int. Cl.[4] ..... F42B 5/02

[52] U.S. Cl. ..... 102/430; 102/431; 102/439; 102/469; 102/513

[58] Field of Search ..... 102/434, 430, 469, 470, 102/513, 439

[56] References Cited

U.S. PATENT DOCUMENTS

| | | | |
|---|---|---|---|
| 421,307 | 2/1890 | Reynolds | 89/26 |
| 3,547,030 | 12/1970 | Kamp et al. | 102/434 |
| 3,680,484 | 8/1972 | Stetter | 102/513 |
| 4,444,115 | 4/1984 | Romu et al. | 102/430 |
| 4,492,167 | 1/1985 | Brede | 102/470 |

FOREIGN PATENT DOCUMENTS

| | | | |
|---|---|---|---|
| 47384 | 3/1982 | European Pat Off. | 102/430 |

*Primary Examiner*—Harold J. Tudor

[57] ABSTRACT

The target-effective mass of cartridged ammunition is increased while maintaining a predetermined cartridge length.

A projectile body has a projectile tail portion extending rearwardly on which a fin or wing-stabilization arrangement is mounted. This tail portion extends rearwardly towards the immediate vicinity of the propellant charge casing bottom. A projection extends rearwardly past the wing or fin-stabilization guide arrangement. This projection includes a massive portion which separates at firing from the propellant charge casing bottom. The rear portion of the projectile body is surrounded by a sheathing of combustible material forming the ignition element which sheathing extends from the cartridge case bottom up to at least the middle of the propellant charge casing and has a longitudinal extent $l_2$. The massive projection permits, during the combustion of the propellant charge up to separation the build up of a high gas pressure, whereby in particular a loose powder propellant charge is ignited by the ignition element for a short period of time in a uniform and reproducible manner. Thus, without increasing the length of the cartridge an increase of the target-effective mass and an increase of the projectile length is achieved with an accompanying penetration capacity increase by improving the relationship of the projectile length $l_1$ to the projectile diameter $d_1$.

7 Claims, 3 Drawing Figures

CARTRIDGED AMMUNITION FOR GUN BARREL WEAPONS

BACKGROUND OF THE INVENTION

A cartridge casing in which a fin or wing-stabilized projectile is mounted is known and is described in German Pat. No. 10 13 202. In this cartridge casing of the state of the art the projectile body is joined to the casing bottom until firing via a comparatively long ignition pipe. An ignition charge mounted at the tail of the projectile is initiated via this long ignition pipe. Long ignition pipes are also used with sabot-ammunition, in particular, for the uniform ignition of loose powder charges. Such long ignition pipes have, however, the drawback that within the same casing length, the length and thereby the target-effective mass of the projectile is limited by the ignition pipe.

SUMMARY OF THE INVENTION

It is a principal object of this invention to increase the target-effective mass of the projectile while at the same time maintaining a given cartridge casing length.

This object is attained by providing a novel type of cartridge casing in which the entire axial length of the inner space can be used as a target-effective useful projectile extension. The body of the projectile is extended, by substantially increasing the target-effective mass and by mounting the wing or fin-stabilization guide means on the tail of the projectile and extending it back to the immediate vicinity of the bottom of the propellant charge casing, whereby this extension constitutes a rigidly secured portion of the projectile body. This extension includes a massive projection extending rearwardly from the guide means which separates from the propellant charge casing at firing.

It has been found to be particularly advantageous that the mass of the projection, which is joined to the propellant charge casing and the tail of the projectile, partly remains with the projectile body after firing for increasing the effectiveness at the target. It is possible, without requiring the exterior dimensions of the cartridge to be increased, to obtain a projectile lengthening with a concomitant penetration improvement by improving the relationship of the projectile length to the projectile diameter $l_1/d_1$ independency with the projectile geometry and velocity.

In addition to the lengthening of the projectile body towards the rear into the vicinity of the cartridge casing bottom, the target-effective mass is increased by the massively constructed rear projection of the projectile body, which at its rearmost longitudinal portion is homogeneously joined with the projectile body in the immediate vicinity of an ignition arrangement.

By using a metal with a defined high tensile strength the projection makes possible a good static forcing with a comparatively high static force build up, which after the separation process at the fracture zone, can be repeatedly used with the following projectiles.

By constructing the fracture zone by means of a V-shaped recess and a tearing surface it is possible by providing a comparatively high axial predetermined minimum tensile strength, to produce an exactly reproducible separation of a projecting portion disposed in the wall of the cartridge casing bottom from the tail portion of the projectile, respectively the ignition arrangement from the projection, which increases the efficacy at the target.

The fracture zones provide a high tensile strength in the immediate vicinity of the ignition arrangement, whereby means of the stable mechanical joining of the masses of the projectile body and the propellant charge casing prior to firing an increased transport safety is achieved when different vibratory movements occur. The non-effective mass at the target is reduced by the projectile guide means having an open tracer composition channel mounted at the rear of the projectile, which composition is mounted in the fixing attachment for the guide wings and surrounds the projectile body projection.

In a further advantageous construction of the invention an ignition element, extends from the bottom to at least the middle of the propellant charge casing and surrounds in the form of a housing the projectile body. This ignition element does not influence the overall length of the projectile. This ignition element provides in addition to a uniform reproducible combustion a high gas pressure build up for a burning of short duration and the production of a high acceleration force.

The ignition element consists, on the one hand, of a combustible propellant charge ignition pipe enveloping a charge, and on the other hand, of at least one set of pipe powder rods which ring-like surround the projectile body. A uniform ignition of the propellant charge is further produced in an advantageous manner by means of a rapid flame conduction either via a free annular chamber disposed between the projectile body and the charge that is mounted within the ignition pipe, or through the free space extending parallel to the projectile axis between and through the pipe powder rods. Both types of ignition provide a particular uniform igniting of loose powder charges, which, compared to known pipe powder charges, distinguish themselves by means of a light loose mixture, dosing and application in the propellant charge casing.

BRIEF DESCRIPTION OF THE DRAWING

With these and other objects in view, which will become apparent in the following detailed description, the present invention, which is shown by example only, will be clearly understood in connection with the accompanying drawing, in which.

DETAILED DESCRIPTION

Figure 1:
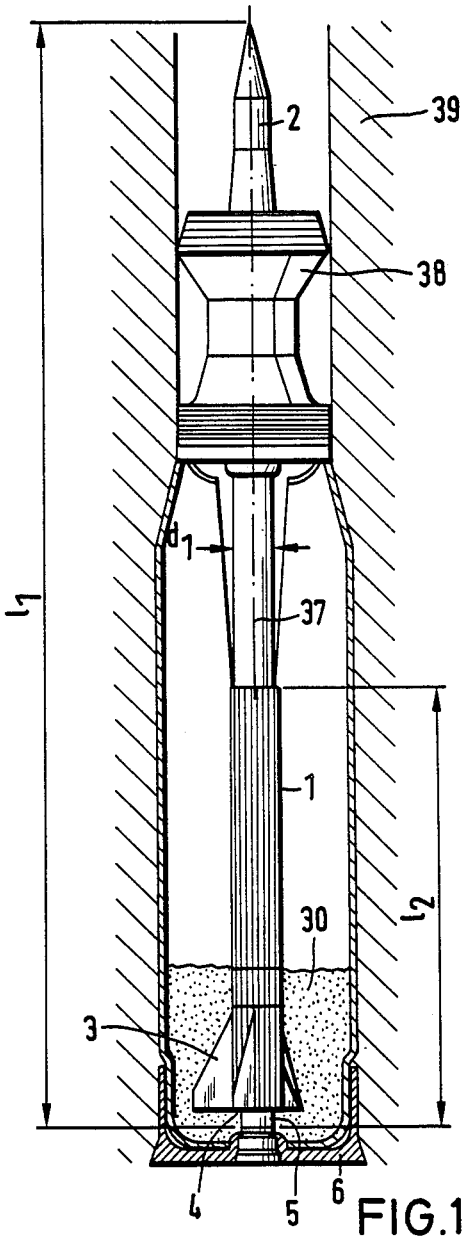
FIG. 1 is a longitudinal sectional view of a sabot-projectile having a tail which extends rearwardly close to the casing bottom.

FIG. 1 illustrates a projectile body 2 which has mounted thereon in the forward region of the projectile a sabot 38 of known construction. This projectile is fired with high kinetic energy from a gun barrel 39 of a non-illustrated gun barrel weapon by means of a propellant charge 30 mounted within a propellant charge casing. The projectile body 2 has a projectile tail 4 on which a wing a fin-stabilization arrangement 3 is mounted. The projectile tail 4 extends rearwardly to the immediate vicinity of the propellant charge casing bottom 6. a massive projection 5 is mounted in the casing bottom 6 but is separable from the propellant charge casing bottom 6. The projection 5 extends past the fin-stabilization arrangement 3. The projectile body 2 is enveloped by means of a cylindrical portion 1 extending from the propellant charge casing bottom 6 a distance $l_2$ up to the middle of the propellant charge casing which cylindrical portion l forms the ignition element for the propellant charge 30, whereby the projectile tail portion 4 is enveloped by the cylindrical portion forming the ignition element l over a length that may extend up to the sabot 38. By making the length $l_2$ of the projectile body to substantially correspond to the maximum length of the projectile body there is achieved a substantially improved relationship of the projectile length $l_1$ to the projectile diameter $d_1$ making for a compartively improved penetration capacity.

Figure 2:
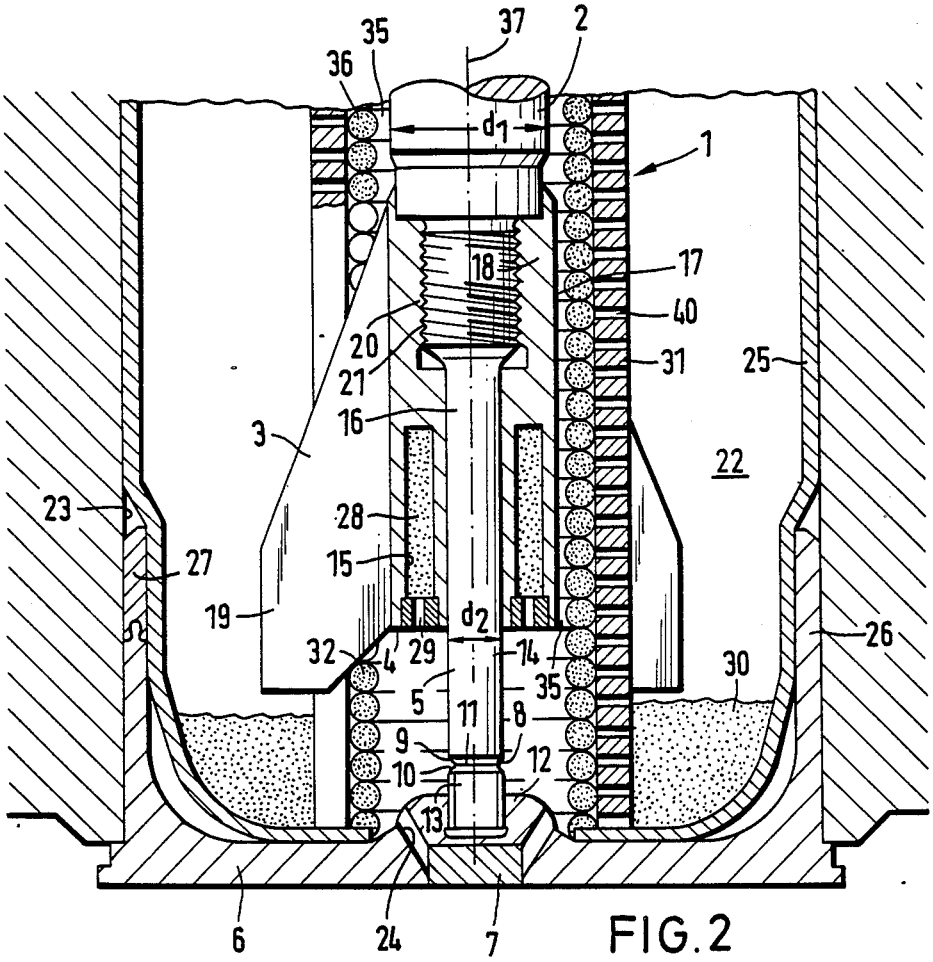
FIG. 2 is a cross-sectional view of the rear portion of the propellant charge casing, shown at an enlarged scale relative to FIG. 1, which also illustrates the tail portion of the projectile which is joined to the propellant charge casing as well as the arrangement of an ignition, which envelopes the projectile body.

FIG. 2 illustrates the manner in which the projectile body 2 is fastened at its rear onto the propellant charge casing bottom 6 and the manner in which the cylindrical portion of the ignition element 1 surrounds the projectile body 2.

The projectile body 2 has a multi-stepped configuration at its rear end, whereby the projectile portion 20 has an exterior threaded length 21 for threadably mounting the fin-stabilization guide arrangement 3 thereon. An axially rearwardly projecting portion 5 forms part of a stepped down part 16 and has a stepped-down diameter $d_2$ relative to the projectile diameter $d_1$. This portion 5 extends axially rearwardly from the fin-stabilization arrangement 3 at the projectile tail 4 and represents, prior to firing, a joining element forming a stable joint between the ignition cap 7 of the propellant charge casing bottom 6 and the projectile body 2. The projection 5 is of massive construction and consists of a metal alloy having a defined texture and a comparatively high tensile strength. It includes a forwardly projecting member 13 in the immediate vicinity of the slightly bulging bottom wall 12 of the propellant charge casing bottom 6, which bulge projects into the propellant charge chamber 22 and receives from the rear the ignition cap 7. The member 13 and portion 5 are separated by an annular V-shaped groove 10 having a tearing surface 11, whereby a static forcing with a relatively high axially directed predetermined minimum tensional force provides an exact separation of the member 13 from the rear portion 5 of the projectile tail 4. This member 13 is mounted in the wall 12 of the propellant charge casing bottom 6 in which also the ignition cap 7 is mounted. The tail portion 5 forms part of a member 14 which increases the target-effective mass of the projectile body 2.

The separation of the rear projecting portion 5 results after ignition of the propellant charge 30 which is disposed within the propellant charge casing bottom 6 and the propellant charge casing as a result of a pressure build up which exceeds the minimum tensional strength of the fracture zone 8 and which propels the projectile.

The ignition is initiated by means of the release of an ignition cap 7 axially mounted in the propellant charge casing bottom 6 by means of electrical or mechanical means. The casing bottom 6 has a pair of inclined bores extending therethrough via which a charge 32 mounted in a propellant charge ignition pipe 31 (formed as an ignition element 1, see FIG. 2) or an auxiliary charge 34 mounted on top of the propellant charge casing bottom 6 (see FIG. 3) is ignited.

The ignition element 1 formed by means of an ignition pipe 31, as illustrated in FIG. 2, consists of combustible material, whereby obstacles for the fin or wing-stabilization guide arrangement 3 are advantageously eliminated.

The charge 32 which is enveloped by the ignition pipe 31 is arranged in the form of ring tablets 36 or rods and consists of an ignition mixture, preferably made of boron potassium nitrate ($BKNO_3$). The ring tablets 36 or rods are guided through the inner wall of the pipe of the ignition pipe 31 and define between themselves and the projectile body 2 a free annular space 35 for a quick flame guidance. By igniting the ignition charge 32 the outlet openings 40 of the ignition pipe 31 are opened so that a uniform ignition of the propellant charge 30 can be obtained, which propellant charge 30 is preferably made out of a loose powder propellant charge material.

In order to achieve an easy assembly above all in the region of the stabilization wing 19, the ignition pipe 31 is either segment-like divided completely parallel to the projectile axis 37 and is a non-illustrated manner centered or is slotted in the region of the stabilization wing 19. Correspondingly, the ring tablets 36 are formed in the region of the stabilization guide arrangement 3 also as coupled ring segments.

The propellant charge casing bottom 6 consists of a combustible casing portion 25 and a casing stump portion 26 which is made of metal. The casing portion 25 can be sealed vis a vis the wall 23 of a gun barrel bore either by the stepped stop 26 or by means of a seal 27.

The fin or wing-stabilization guide arrangement 3 consists of a housing 18 and a plurality of fins or wings 19 extending thereform, which wings are mounted on the outer periphery 17 of the housing 18 and are dimensioned insofar as their width is concerned so that they do not come into contact with the walls of the gun barrel 39 (FIG. 1). The outer surface 17 of the housing 18 corresponds to the projectile diameter $d_1$ so that by means of the multi-stepped reduction of the projectile tail there cannot result any aerodynamic drawbacks.

The housing 18 which serves to mount the wings or fins of the wing or fin-stabilization guide arrangement 3 on the projectile include in the region between the diameters $d_1$ and $d_2$ a ring channel 15 for receiving a hollow cylindrically shaped tracer composition 28, which composition is expellable via a plurality of bores 29. By means of the arrangement of the ring channels 15 the target-effective mass of the wing or fin stabilization guide arrangement 3 is further reduced, so that a projectile body 2 results, the penetration force of which is increased, on the one hand, by the reduction of the target-non-effective mass and, on the other hand, by increasing the target-effective mass as a result of the improvement of the relationship of projectile length $l_1$ to projectile diameter $d_1$.

Figure 3:
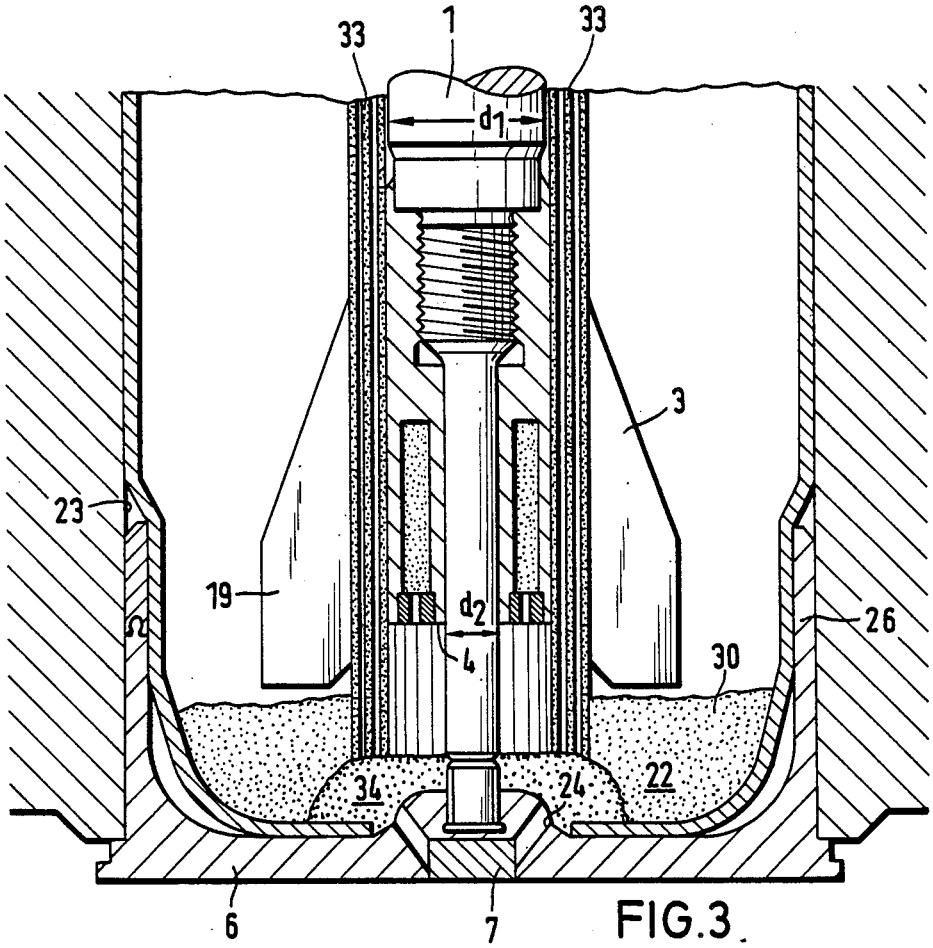
FIG. 3 is a cross-sectional view similar to FIG. 2 of an alternate embodiment of that portion of the ignition element shown in FIG. 2.

FIG. 3 clearly illustrates a further embodiment of the projectile body 2 which includes a housing-shaped enveloping ignition element 1. The latter consists of a plurality of pipe powder rods 33 which surround in the shape of a pipe the projectile body 2, and which is ignitable at the projectile tail 4 by the ignition cap 7 mounted on the propellant charge casing bottom 6 by means of an auxiliary charge 34 consisting of black powder which is ignitable at its end face. A rapidly axially progressing flame guidance and a uniform ignition of the propellant charge 30 is achieved via the free spaces defined between and through the pipe powder rods.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

We claim:

1. Improved cartridged ammunition for gun barrel weapons having a projectile with wing stabilization means coaxially mounted thereon which projectile is mounted in a cartridge casing, the improvement comprising, said projectile having a longitudinal body from which a tail portion extends axially rearwardly adjacent to the bottom of the cartridge casing;

said tail portion having an axially projecting massive metallic portion integral therewith extending rearwardly past said wing stabilization means and being coupled to said bottom of the cartridge casing, said projecting massive portion separating from said bottom of the cartridge casing at firing of the ammunition by means of a fracture zone located adjacent the bottom of the cartridge casing.

2. Cartridged ammunition according to claim 1, wherein said projectile tail portion has a predetermined strength and is separated from the massive projecting portion by means of a fracture zone, an ignition cap axially mounted in the bottom of the cartridge casing immediately adjacent to and rearwardly of said massive projecting portion, said fracture zone including a V-shaped annular groove and a separable tearing surface, whereby a static forcing with a relatively high predetermined tensile force and an exact separation of the massive projecting portion, mounted in said cartridge casing, from the bottom of the cartridge casing of the projectile is effected.

3. Cartridged ammunition according to claim 2, having the following additional features;

(a) said tail portion axially extending at least partially through said wing or fin stabilization means, at least that part of the tail portion which extends through said wing stabilization means having a reduced diameter which is less than the projectile diameter;

(b) said fin stabilization means includes a housing coaxially mounted on said tail portion, and a plurality of wings equiangularly mounted on said housing;

(c) said projectile having the diameter $d_1$ and tail portion having the diameter $d_2$, said housing having an annular channel of a diameter $d_3$, whereby $d_2<d_3<d_1$, and a tracer composition mounted in said annular channel.

4. Cartridged ammunition according to claim 3, wherein said projectile body has an ignition element extending from the bottom of the cartridge casing forwardly up to the middle of the cartridge casing, said ignition element being in the form of an envelope which encases said projectile body and tail portion.

5. Cartridged ammunition according to claim 4, wherein said ignition element which encompasses said projectile body and tail portion consists of a combustible propellant charge ignition pipe and an explosive charge disposed therein.

6. Cartridged ammunition according to claim 5, including the following features:

(a) the explosive disposed in the combustible propellant charge ignition pipe is in the form of ring tablets stacked one on top of the other or in the form of parallel rods;

(b) the ring tablets or rods are disposed in the propellant charge ignition pipe in such a way that a free space is defined between them and the projectile body.

7. Cartridge ammunition according to claim 4, wherein said ignition element which encompasses said projectile body and tail portion consists at least of a plurality of pipe powder rods which form a ring that surrounds the projectile body, an ignition cap and auxiliary charge are operatively mounted in the bottom of the cartridge casing for igniting said ignition element.

* * * * *